US011628474B2

(12) United States Patent
Wojciechowski et al.

(10) Patent No.: US 11,628,474 B2
(45) **Date of Patent: *Apr. 18, 2023**

(54) METHOD AND APPARATUSES FOR PRE-SCREENING

(71) Applicant: Derrick Corporation, Buffalo, NY (US)

(72) Inventors: Keith Wojciechowski, Lakeview, NY (US); Christian Newman, Lakeview, NY (US)

(73) Assignee: DERRICK CORPORATION, Buffalo, NY (US)

( * ) Notice: Subject to any disclaimer, the term of this patent is extended or adjusted under 35 U.S.C. 154(b) by 836 days.

This patent is subject to a terminal disclaimer.

(21) Appl. No.: 16/503,331

(22) Filed: Jul. 3, 2019

(65) Prior Publication Data

US 2019/0321856 A1 Oct. 24, 2019

Related U.S. Application Data

(63) Continuation of application No. 13/860,116, filed on Apr. 10, 2013, now Pat. No. 10,350,640, which is a continuation of application No. 12/051,658, filed on Mar. 19, 2008, now Pat. No. 8,439,203.

(60) Provisional application No. 60/919,417, filed on Mar. 21, 2007.

(51) Int. Cl.

| | |
|---|---|
| ***B07B 1/28*** | (2006.01) |
| ***B07B 1/30*** | (2006.01) |
| ***B07B 1/42*** | (2006.01) |
| ***B07B 1/46*** | (2006.01) |

(52) U.S. Cl.
CPC ..... *B07B 1/28* (2013.01); *B07B 1/30* (2013.01); *B07B 1/42* (2013.01); *B07B 1/46* (2013.01); *B07B 1/4609* (2013.01)

(58) Field of Classification Search
CPC .... B07B 1/28; B07B 1/30; B07B 1/42; B07B 1/46; B07B 1/4609
See application file for complete search history.

(56) References Cited

U.S. PATENT DOCUMENTS

| | | | | |
|---|---|---|---|---|
| 1,874,916 A | | 8/1932 | Culver | |
| 2,817,442 A | | 12/1957 | Glascoff | |
| 3,863,847 A | | 2/1975 | Day et al. | |
| 4,319,993 A | * | 3/1982 | Krause | B07B 1/30 209/412 |
| 5,273,164 A | | 12/1993 | Lyon | |
| 5,429,247 A | | 7/1995 | Lemay et al. | |

(Continued)

FOREIGN PATENT DOCUMENTS

| | | |
|---|---|---|
| CA | 2346025 A1 | 4/2000 |
| CN | 2223147 Y | 3/1996 |

(Continued)

*Primary Examiner* — Michael McCullough
*Assistant Examiner* — Kalyanavenkateshware Kumar
(74) *Attorney, Agent, or Firm* — FisherBroyles, LLP; Jason P. Mueller

(57) ABSTRACT

A vibratory screening machine includes a primary screening area and a pre-screening assembly including a frame and screen assemblies. The screen assemblies are secured to the frame and form a pre-screening surface. The frame is attached to the vibratory screening machine such that the concave pre-screening surface is above the primary screening area.

35 Claims, 19 Drawing Sheets

(56) References Cited

U.S. PATENT DOCUMENTS

| | | | | |
|---|---|---|---|---|
| 5,816,413 | A | 10/1998 | Boccabella et al. | |
| 6,439,391 | B1 | 8/2002 | Seyffert | |
| 6,736,271 | B1 | 5/2004 | Hall | |
| 6,820,747 | B2 | 11/2004 | Watters et al. | |
| 6,892,891 | B2 | 5/2005 | Dias | |
| 6,953,121 | B2 | 10/2005 | Olsen et al. | |
| 2002/0195377 | A1* | 12/2002 | Trench | B07B 1/4645 209/412 |
| 2003/0015460 | A1 | 1/2003 | Ballman et al. | |
| 2004/0016682 | A1 | 1/2004 | Tsutsumi | |
| 2006/0163120 | A1 | 7/2006 | Doppstadt et al. | |
| 2007/0144945 | A1 | 6/2007 | Malmberg | |
| 2008/0093268 | A1* | 4/2008 | Hukki | B07B 1/4654 209/397 |

FOREIGN PATENT DOCUMENTS

| | | | |
|---|---|---|---|
| CN | 2458092 | Y | 11/2001 |
| CN | 2546099 | Y | 4/2003 |
| CN | 1809427 | A | 7/2006 |
| DE | 2348073 | A1 | 4/1975 |
| GB | 2085745 | A | 5/1982 |
| SU | 889143 | A1 | 12/1981 |
| SU | 986513 | A1 | 1/1983 |
| SU | 1194362 | A1 | 11/1985 |
| WO | 9415724 | A1 | 7/1994 |
| WO | 2008116007 | A2 | 9/2008 |

* cited by examiner

METHOD AND APPARATUSES FOR PRE-SCREENING

CROSS-REFERENCE TO RELATED APPLICATIONS

The present application is a continuation of U.S. patent application Ser. No. 13/860,116, filed Apr. 10, 2013, which is a continuation of U.S. patent application Ser. No. 12/051,658, filed Mar. 19, 2008, now U.S. Pat. No. 8,439,203, which claims the benefit of U.S. Provisional Patent Application No. 60/919,417, filed Mar. 21, 2007, the entire contents of each of which are incorporated herein by reference hereto.

FIELD OF THE INVENTION

The present invention relates generally to material screening. More particularly, the present invention relates to a method and apparatuses for pre-screening.

BACKGROUND INFORMATION

Material screening includes the use of vibratory screening machines. Vibratory screening machines provide the capability to excite an installed screen such that materials placed upon the screen may be separated to a desired level. Oversized materials are separated from undersized materials. Over time, screens wear and require replacement. Wear is often attributable to damage caused by oversized materials.

In order to excite an installed screen, existing vibratory screening machines include vibratory motors. The vibratory motors are attached to a frame of the vibratory screening machine and are configured to vibrate the frame and ultimately the installed screens. Such vibratory motors consume significant amounts of power.

SUMMARY

According to an example embodiment of the present invention, a vibratory screening machine provides for vibratory pre-screening of materials. Vibratory pre-screening reduces wear and damage to screens and provides for more effective screening. The vibratory screening machine includes a pre-screening assembly that is designed to be cost effective and can be easily installed on the vibratory screening machine. The pre-screening assembly includes screen assemblies that are configured to be quickly and easily replaced. The pre-screening assembly includes a pre-screening surface. The pre-screening surface may have a concave shape. The term concave as used herein is not limited to curved surfaces but includes any surface configured as a trough or other shape suitable for screening a material. The pre-screening assembly may be configured to be attached to a structural member of the vibratory screening machine such that vibrations of the machine are imparted to the pre-screening assembly. The pre-screening assembly may also be used independently of the vibratory screening machine. The pre-screening assembly may be configured with a pre-screen vibratory motor. The pre-screen vibratory motor may be directly or indirectly attached to the pre-screening assembly. The pre-screen motor may be configured to also provide vibrations to a primary screening surface/area of the vibratory screening machine. Such configurations may reduce the size of and/or eliminate the need for vibratory motors that are configured to vibrate a frame of the vibratory screening machine. The pre-screen vibratory motor may replace vibratory motors configured to vibrate the frame of the vibratory screening machine. The pre-screen vibratory motor may also substantially isolate vibrations to the pre-screening assembly and/or the primary screening surface.

According to an example embodiment of the present invention, a vibratory screening machine includes a central member, a primary screening area/surface and a pre-screening assembly. The pre-screening assembly includes a frame and screen assemblies. The frame includes a central spine and ribs. The screen assemblies are secured to the frame and form a concave pre-screening surface. The central spine of the pre-screening assembly is attached to the central member of the vibratory screening machine such that the concave pre-screening surface is above the primary screening surface.

According to an example embodiment of the present invention, a vibratory screen machine includes wall members, a support surface, a central member attached to the support surface, a primary screening surface, an acceleration arrangement and a pre-screening assembly. The pre-screening assembly includes a frame and screen assemblies. The frame includes a central spine and ribs. The screen assemblies are secured to the frame and form a concave pre-screening surface. The central spine of the pre-screening assembly is attached to the central member of the vibratory screening machine such that the concave pre-screening surface is above the primary screening surface. The acceleration arrangement is configured to impart an acceleration or vibrations to the primary screening area and the concave pre-screening surface. The pre-screening assembly may include its own pre-screen vibratory motor. The pre-screen vibratory motor may also be utilized to accelerate or vibrate the primary screening surface with or without the acceleration arrangement.

According to an example embodiment of the present invention, a vibratory screen machine includes a primary screening surface and a pre-screening assembly attached to the vibratory screening machine. The pre-screening assembly includes an elongated frame for supporting a concave screening surface. The concave screening surface is used for the pre-screening of materials before they contact the primary screening area.

The frame may include a central spine running down the length of the frame and supporting ribs. The supporting ribs may have substantially horizontal and vertical portions. The substantially horizontal portions may extend substantially perpendicularly from the central spine and be securely fastened to the central spine. The substantially vertical portions may be attached to and extend substantially perpendicular to the substantially horizontal portions. Longitudinal spacing pieces may be located at intersections of the horizontal and vertical portions and may securely fasten and connect separate intersections of the horizontal and vertical portions such that a space is maintained between the supporting ribs. Longitudinal spacing pieces may also be provided at the upper ends of the vertical supporting portions and may securely fasten and connect the separate upper ends of the vertical portions such that a space is maintained between the supporting ribs. The horizontal and vertical portions may be made from a single piece of material such as a metal, plastic, composite material, etc. Alternatively, the horizontal and vertical portions may be made from separate pieces of material. A central key piece may be provided on the spine to provide for a mating surface with a spine of another pre-screen assembly. An attachment arrangement may be configured to secure the frame to a pre-screen vibratory motor. A pre-screen vibratory motor may be provided that is securable to the attachment arrangement.

The pre-screening assembly may include a screen assembly attachment arrangement. The screen assembly attachment arrangement may be any arrangement suitable for securing screen assemblies to the frame. The screen assembly attachment arrangement may include a pre-tensioned spring clamp configured to clamp screen assemblies to the frame.

The screen assemblies may be molded, cast or welded and may be formed as a single unit. The screen assemblies may be provided with a coating such as a polyurethane or other suitable material for handling and wear resistance. The screen assemblies may also include screen frame members and screens. The screens may include mesh or multiple mesh layers. The screen frame members may be rigid or semi-rigid. Separate screen assemblies may be provided for horizontal portions and vertical portions. The screen assemblies may be configured to form the concave screening surface. The pre-tensioned spring clamp may be configured to press the horizontal portion screen assemblies and vertical portion screen assemblies together to form the concave screening surface.

The vibratory screening machine may include a feeder that is configured to divert material flow to or away from the pre-screening assembly. The feeder may also be configured to provide a flow of material to both the pre-screen assembly and the primary screening area/surface. The feeder may be configured to provide a flow of material to multiple pre-screening assemblies. The pre-screening assemblies may include a flange for attachment to the feeder.

According to an example embodiment of the present invention, a pre-screening assembly for a vibratory screening machine includes a frame and screen assemblies. The frame includes a central spine and ribs. The central spine of the pre-screening assembly is attached to the vibratory screening machine and the screen assemblies are secured to the frame and form a concave pre-screening surface.

According to an example embodiment of the present invention, a pre-screening assembly for a vibratory screening machine includes an elongated frame and screen assemblies. The frame includes a central spine and ribs. The central spine of the pre-screening assembly is attached to the vibratory screening machine and the screen assemblies are secured to the frame.

The ribs may form a concave shape and support the screen assemblies. The central spine may run down the length of the frame. The supporting ribs may have substantially horizontal and vertical portions. The substantially horizontal portions may extend substantially perpendicularly from the central spine and be securely fastened to the central spine. The substantially vertical portions may be attached to and extend substantially perpendicular to the substantially horizontal portions. Longitudinal spacing pieces may be located at intersections of the horizontal and vertical portions and may securely fasten and connect separate intersections of the horizontal and vertical portions such that a space is maintained between the supporting ribs. Longitudinal spacing pieces may also be provided at the upper ends of the vertical supporting portions and may securely fasten and connect the separate upper ends of the vertical portions such that a space is maintained between the supporting ribs. The horizontal and vertical portions may be made from a single piece of material such as a metal, plastic, composite material, etc. Alternatively, the horizontal and vertical portions may be made from separate pieces of material. A central key piece may be provided on the spine to provide for a mating surface with a spine of another pre-screen assembly. An attachment arrangement may be configured to secure the frame to a pre-screen vibratory motor. A pre-screen vibratory motor may be provided that is securable to the attachment arrangement. Another attachment arrangement may be configured to attach one frame to a similar frame positioned above the frame.

The pre-screening assembly may include a screen assembly attachment arrangement. The screen assembly attachment arrangement may be any arrangement suitable for securing screen assemblies to the frame. The screen assembly attachment arrangement may include a pre-tensioned spring clamp configured to clamp screen assemblies to the frame.

The screen assemblies may include screen frame members and screens. The screens may include mesh or multiple mesh layers. The screen frame members may be rigid or semi-rigid. Separate screen assemblies may be provided for horizontal portions and vertical portions. The screen assemblies may be configured to form the concave screening surface. The pre-tensioned spring clamp may be configured to press the horizontal portion screen assemblies and vertical portion screen assemblies together to form the concave screening surface.

According to an example embodiment of the present invention, a screen assembly for a pre-screen assembly in a vibratory screening machine includes a screen frame member and a screen supported by the screen frame member. The screen assembly may be configured to form a predetermined concave shape when placed in the pre-screen assembly. The screen assemblies may be configured as described above with respect to the vibratory screening machines and the pre-screening assemblies. The screen assembly may include a mating surface configured to interact with a surface of the frame described above.

According to an example embodiment of the present invention, a method for screening materials includes attaching a pre-screen assembly to a vibratory screen machine, the pre-screen assembly including an elongated spine and concave screening surface, pre-screening material on the concave screening surface and screening material on a primary screening area/surface. The method may also include vibrating the pre-screen assembly.

The pre-screening assemblies described above may be incorporated into the method and apparatuses set forth in the U.S. Non-Provisional patent application Ser. No. 11/726,589, entitled "Method and Apparatuses for Screening" filed in the U.S. Patent and Trademark Office Mar. 21, 2007 (bearing document number "NY01 1323920" and having inventors Keith Wojciechowski and Christian Newman), which is incorporated herein by reference in its entirety. For example, the central spine of the pre-screening assemblies described herein may be attached to the central member of the apparatuses described in the above reference non-provisional application.

DETAILED DESCRIPTION

Figure 1:
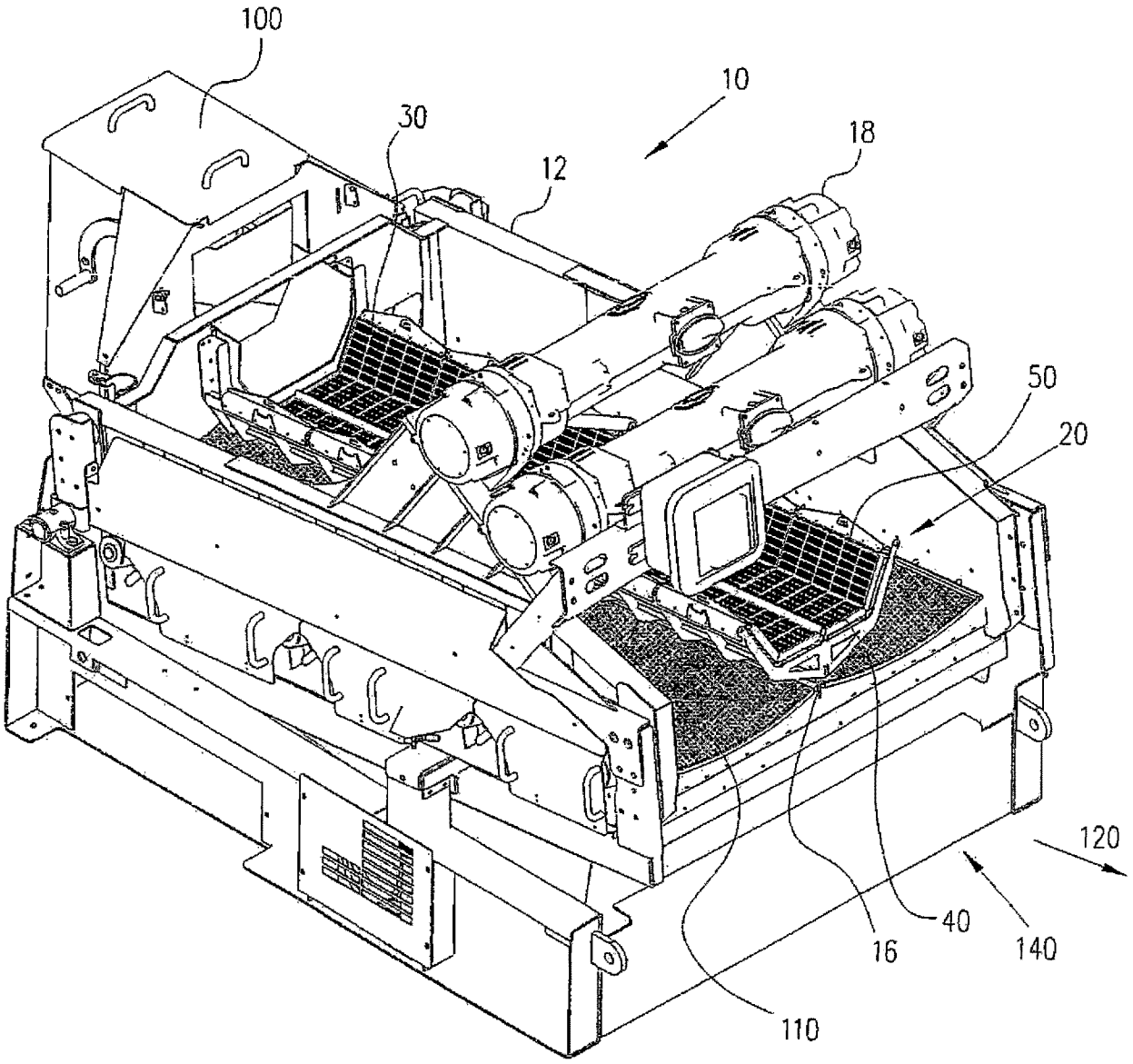
FIG. 1 shows a perspective view of a vibratory screening machine with an installed pre-screening assembly according to an example embodiment of the present invention.

Like reference characters denote like parts in the drawings.

FIG. 1 shows a vibratory screening machine 10 with an installed pre-screening assembly 20. Material is fed into a feeder 100 and then directed onto a concave screening surface 30 of pre-screening assembly 20. Screen assemblies 50 form concave screening surface 30. Undersized material passes through screening surface 30 and onto a primary screening surface 110. Oversized materials are discharge from end 40 of pre-screening assembly 20. Material travels in flow direction 120 toward the vibratory screening machine 10 end 140. The material flowing inside pre-screening assembly 20 is contained within concave screening surface 30. The material may be dry, a slurry, etc.

Vibratory screening machine 10 includes wall members 12, a central member 16 and an acceleration arrangement 18. Central member 16 divides vibratory screening machine 10 into two screening areas. Vibratory screening machine 10 may, however, have one or more concave screening areas.

Figure 2:
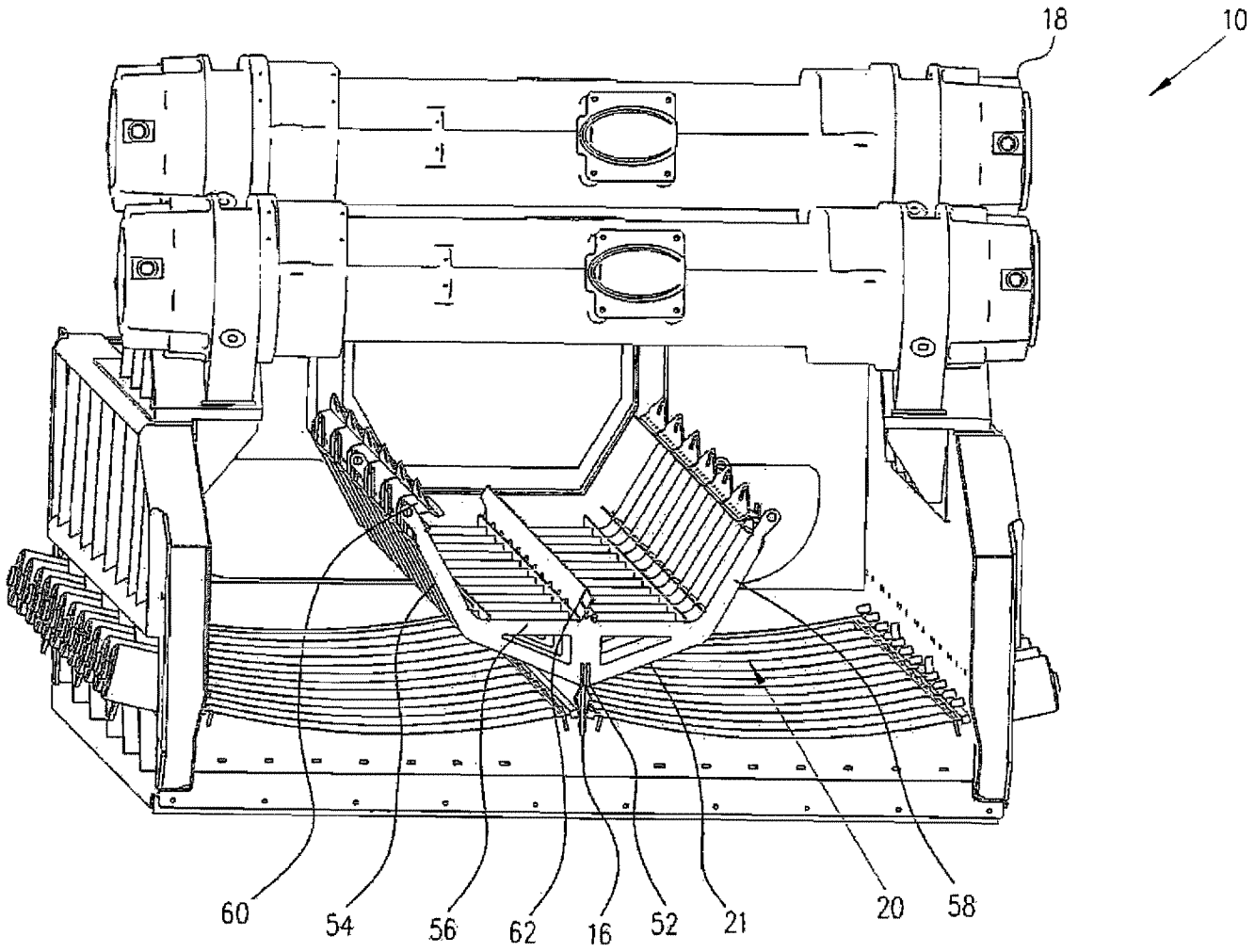
FIG. 2 shows a perspective view of the vibratory screening machine shown in FIG. 1.

FIG. 2 shows the vibratory screening machine shown in FIG. 1 without feeder 100 and without installed screen assemblies 50. Pre-screen assembly 20 includes a frame 21 that includes a central spine 52, ribs 54, horizontal portions 56, vertical portions 58 and a bar 62. Frame 21 has a general hull type shape but may be configured in other arrangements suitable for pre-screening materials. Frame 21 is configured to provide a generally concave surface to support screen assemblies 50. Pre-screen assembly 20 also includes screen assembly attachment arrangements 60 configured to secure screen assemblies 50 to frame 21. Screen assembly attachment arrangements 60 are pre-tensioned spring clamps but may also include other screen securing mechanisms such as mechanical, electromechanical, pneumatic or hydraulic systems.

Figure 3:
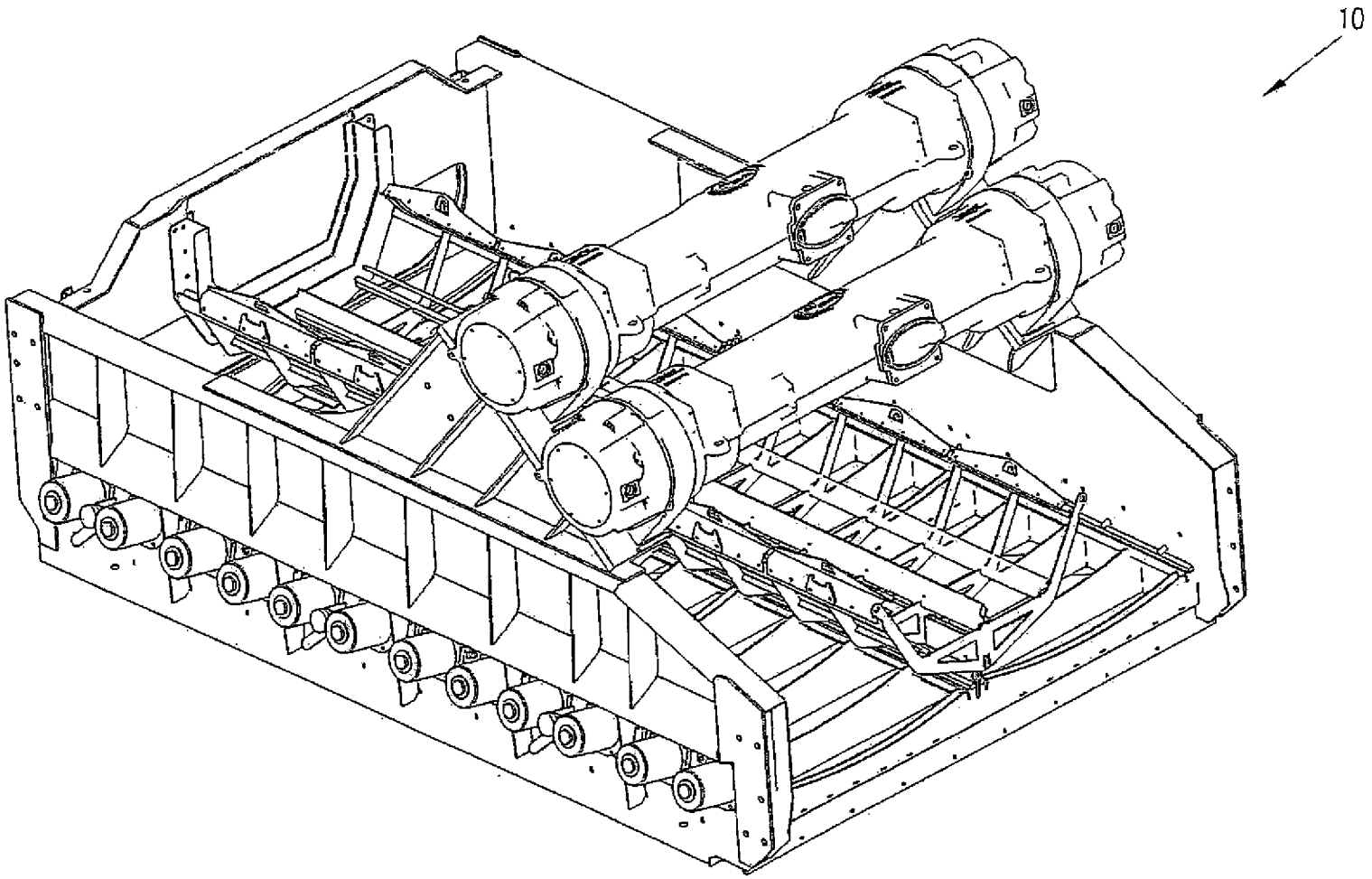
FIG. 3 shows a perspective view of the vibratory screening machine shown in FIG. 1.

FIG. 3 shows the vibratory screening machine 10 without a feeder 100 and without installed screen assemblies 50 and without primary screening surfaces 110.

Figure 4:
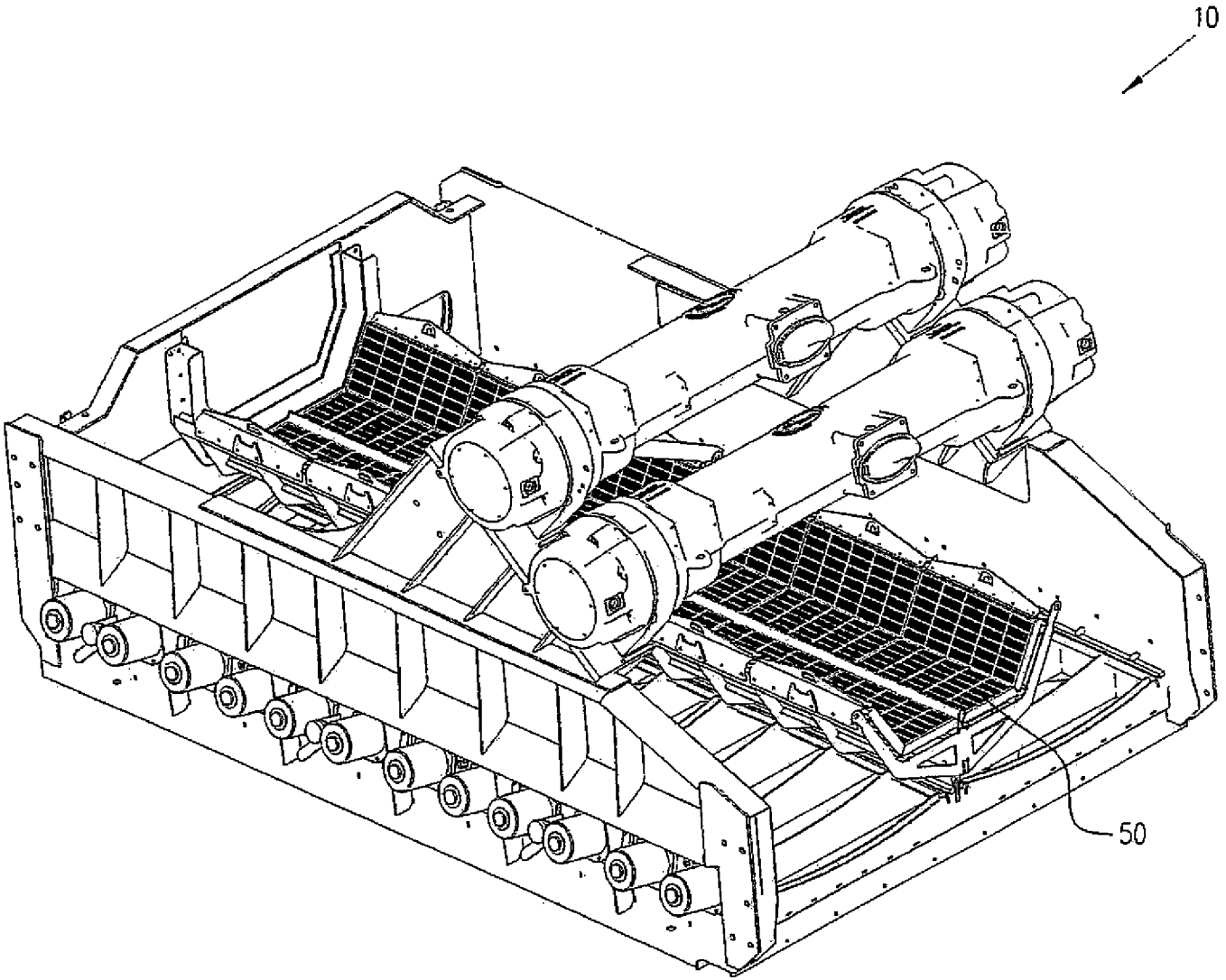
FIG. 4 shows a perspective view of the vibratory screening machine shown in FIG. 1.

FIG. 4 shows vibratory screening machine 10 with screen assemblies 50.

Figure 5:
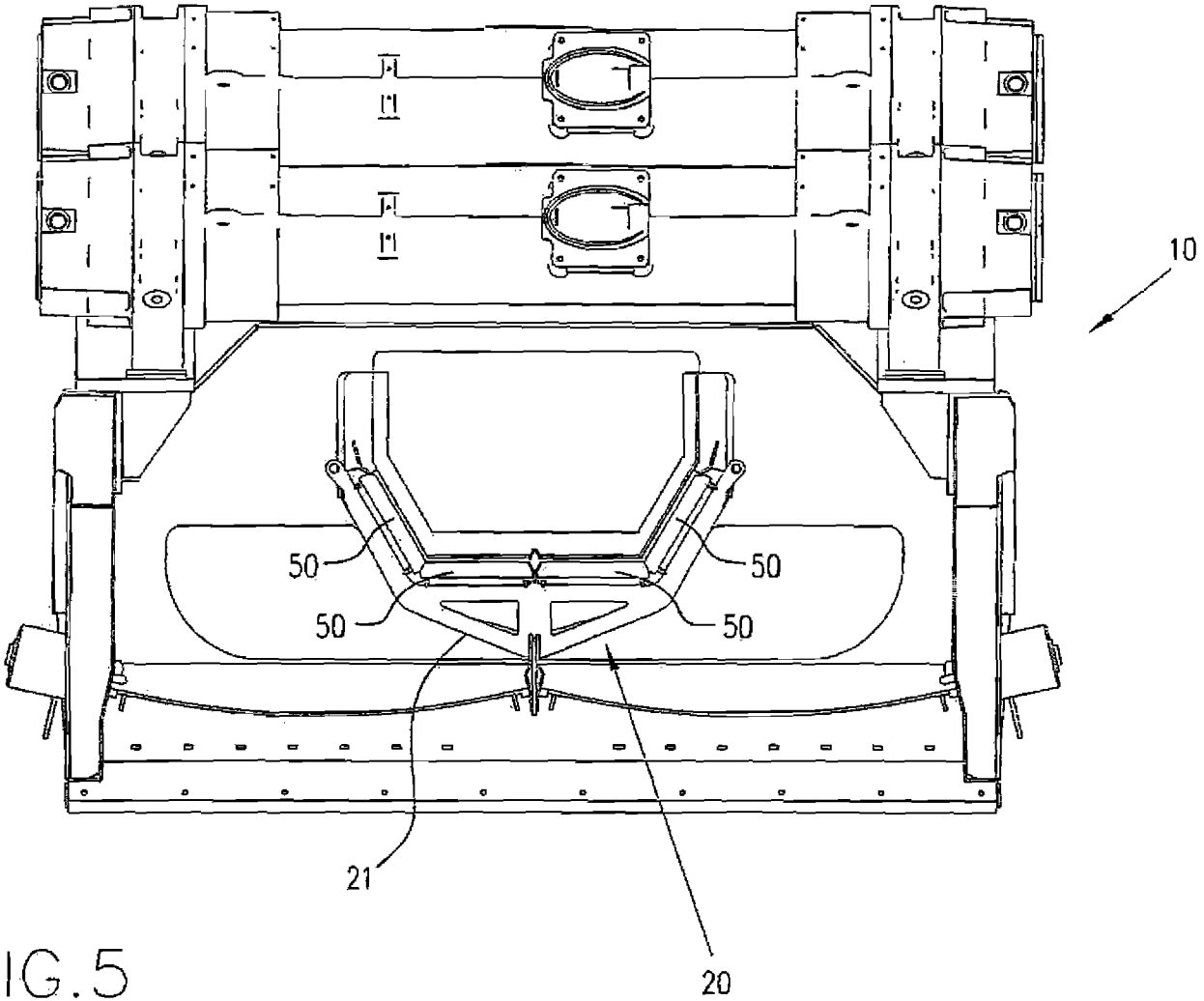
FIG. 5 shows a front view of the vibratory screening machine shown in FIG. 1 without a feeder.

FIG. 5 shows vibratory screening machine 10 with pre-screening assembly 20. Pre-screening assembly 20 includes frame 21 and screen assemblies 50.

Figure 6:
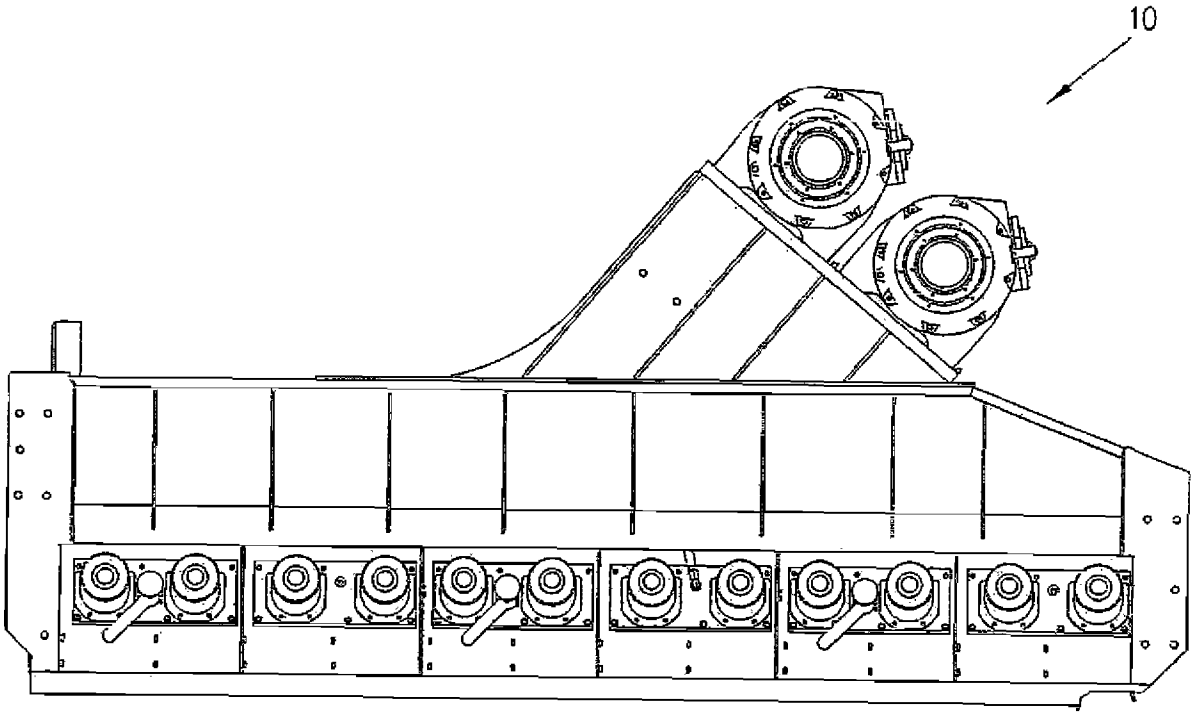
FIG. 6 shows a side view of the vibratory screening machine shown in FIG. 1.

FIG. 6 shows vibratory screening machine 10.

Figures 7, 8:
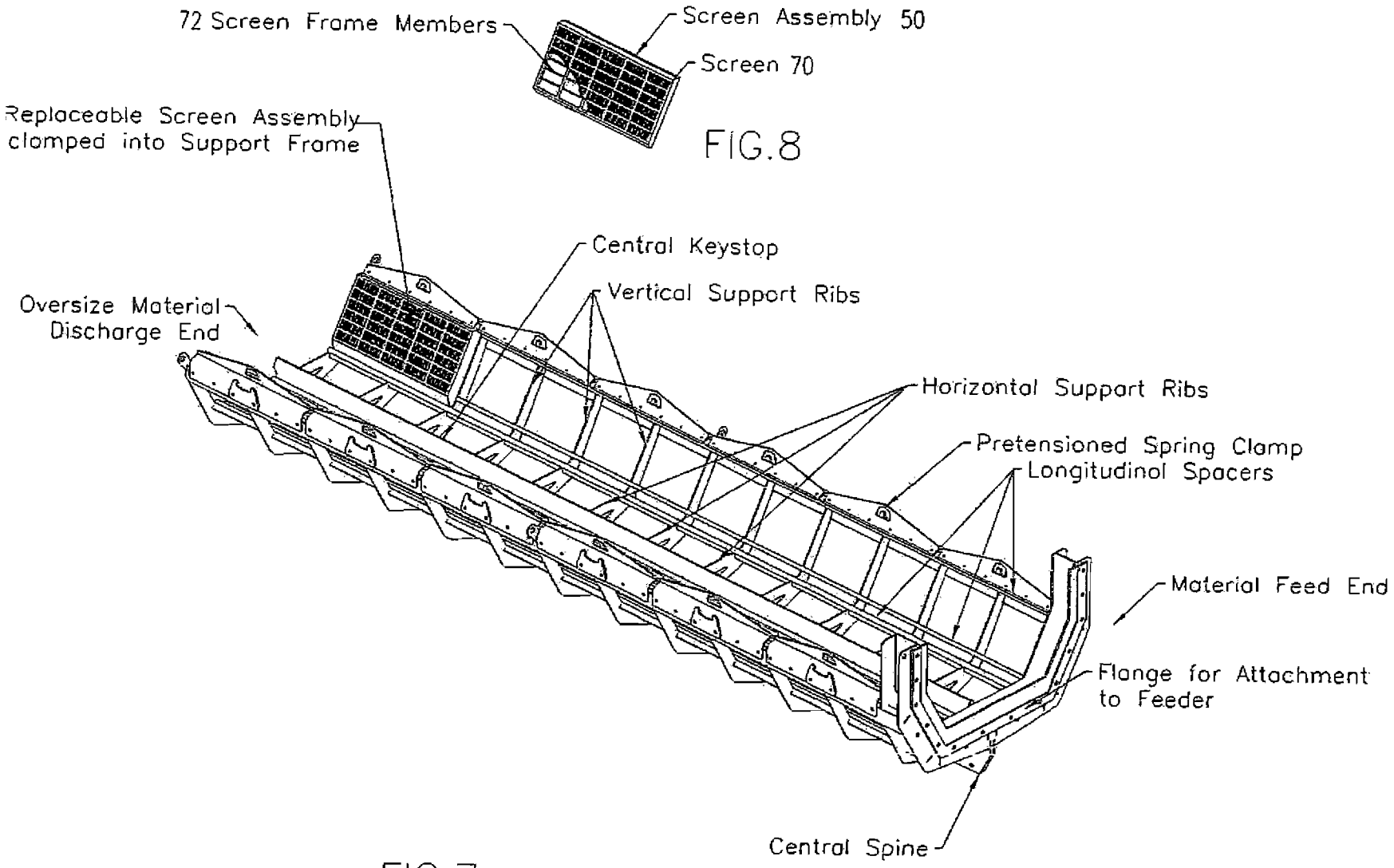
FIG. 7 shows a perspective view of a pre-screening assembly according to an example embodiment of the present invention.
FIG. 8 shows a perspective view of a screen assembly according to an example embodiment of the present invention.

FIG. 7 shows pre-screening assembly 20 with labeled parts.

FIG. 8 shows screen assembly 50. Screen assembly 50 includes screen 70 and screen frame members 72. Screen 70 is a mesh screen but may be any type of screen and may include multiple layers. The layers may be mesh and/or other materials. The screen frame members are plate members but may be any type of structural member including tubing, formed flanges, etc. Screen 70 is attached to the screen frame members 72 by gluing but may be attached by mechanical fastening, welding, etc. Screen assembly 50 is configured to be easily secured to and removed from frame 21. Accordingly, screen assembly may be provided in operator friendly sizes and weights.

The screen assemblies may also be molded, cast or welded and may be formed as a single unit. The screen assemblies may be provided with a coating such as a polyurethane or other suitable material for handling and wear resistance.

Figure 9:
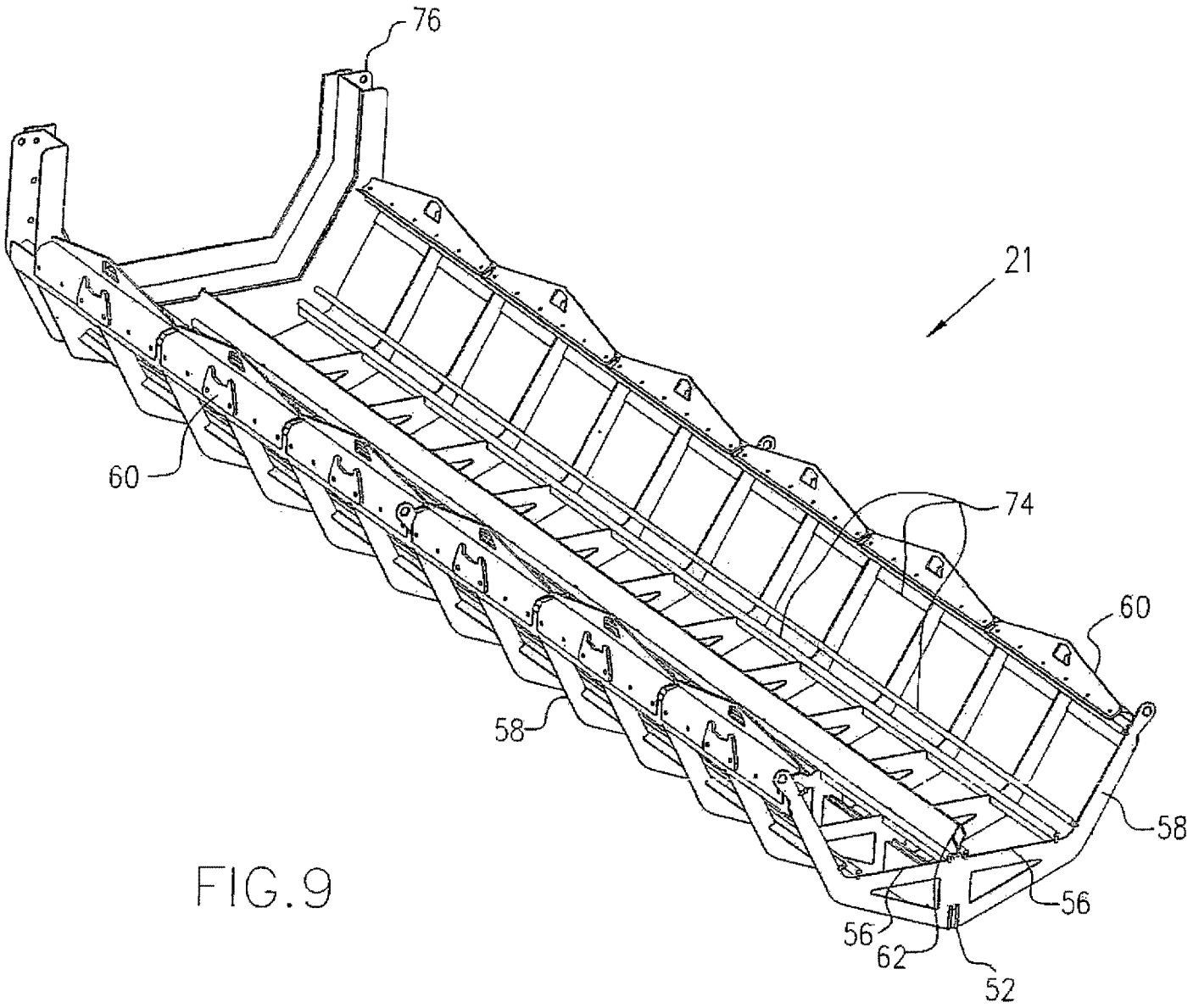
FIG. 9 shows a perspective view of a frame of a pre-screening assembly according to an example embodiment of the present invention.

FIG. 9 shows frame 21. Frame 21 includes central spine 52, substantially horizontal portions 56, substantially vertical portions 58, longitudinal spacing elements 74, bar 62 and flange 76. Flange 76 provides for attachment of frame 21 to feeder 100. Also shown are pre-tension spring clamps 60.

Figure 10:
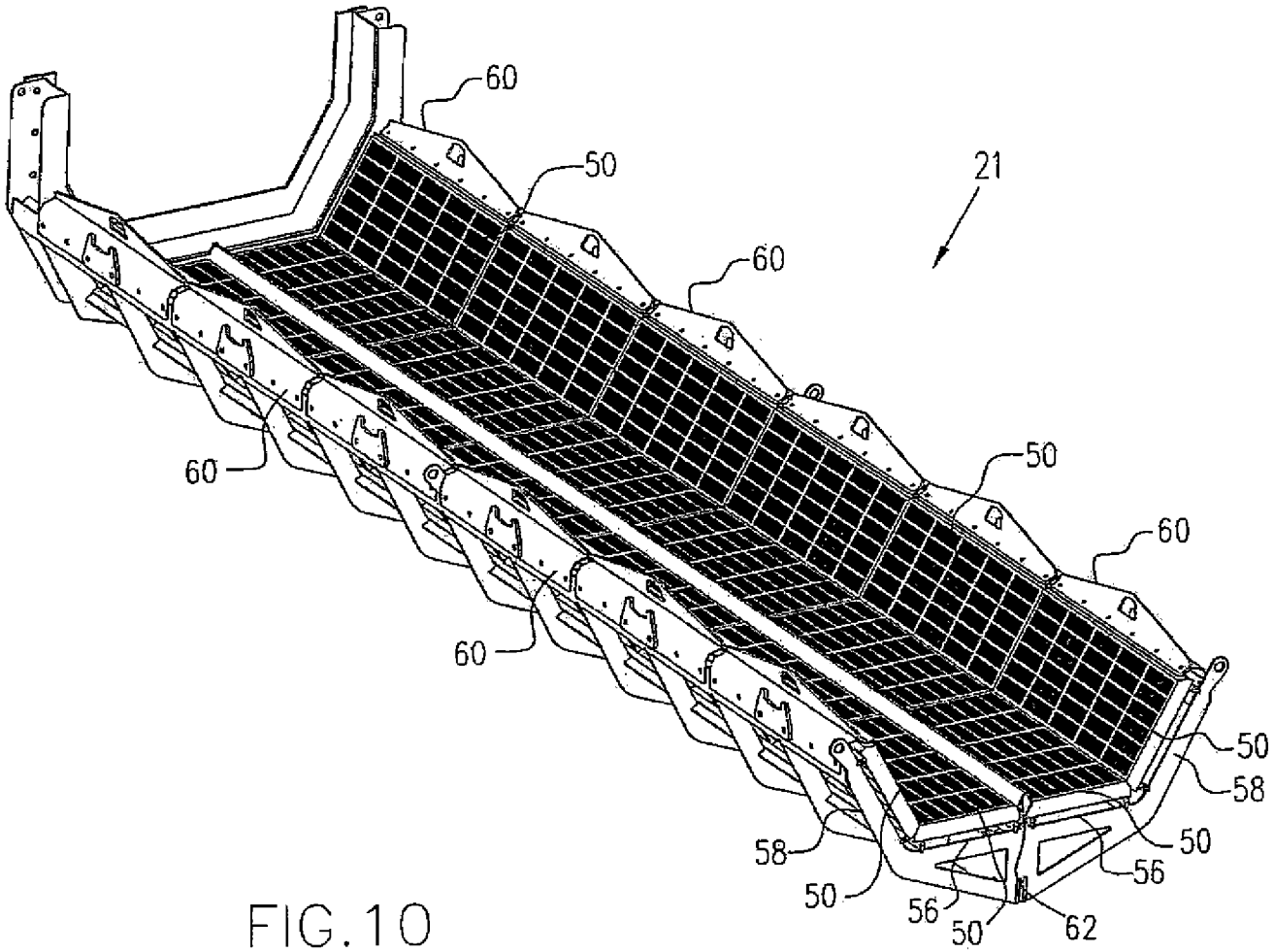
FIG. 10 shows a perspective view of the frame shown in FIG. 9 with installed screen assemblies.
Figure 18:
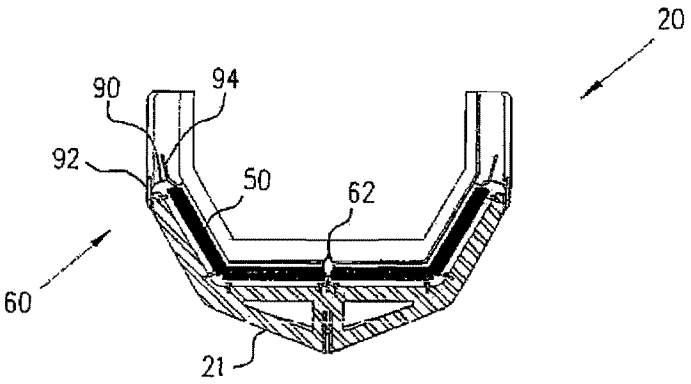
FIGS. 18 to 20 show a cross-sectional view of the removal of a screen assembly according to an example embodiment of the present invention.
Figure 19:
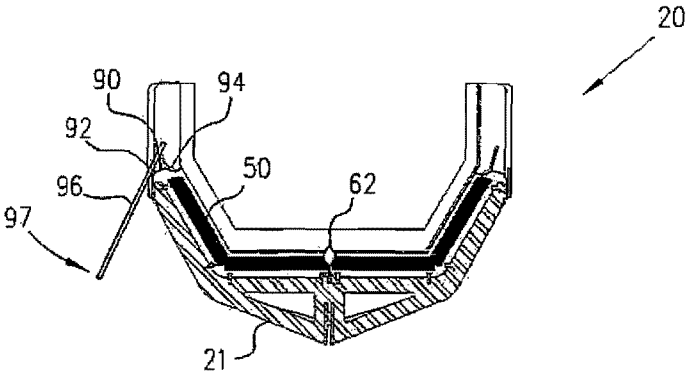
Figure 20:
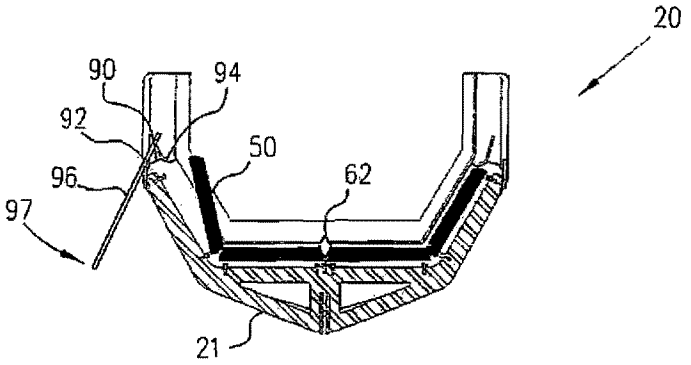

FIG. 10 shows frame 21 with installed screen assemblies 50. Screen assemblies 50 are clamped in place by pre-tension spring clamps 60. Separate screen assemblies 50 are provided on the substantial horizontal portions 56 and substantially vertical portions 58. Portions 56 and 58 may provide other surface configurations for screen assemblies 50, including different angled or contoured formations. Pre-tension spring clamps 60 push against an edge of the screen assemblies 50 (which are in a substantially vertical position). These substantially vertical screen assemblies 50 push against the substantially horizontal screen assemblies 50 which contact bar 62 thereby snugly securing screen assemblies 50 in place. As is shown in FIGS. 18 to 20, screen assemblies 50 are easily replaceable.

Figure 11:
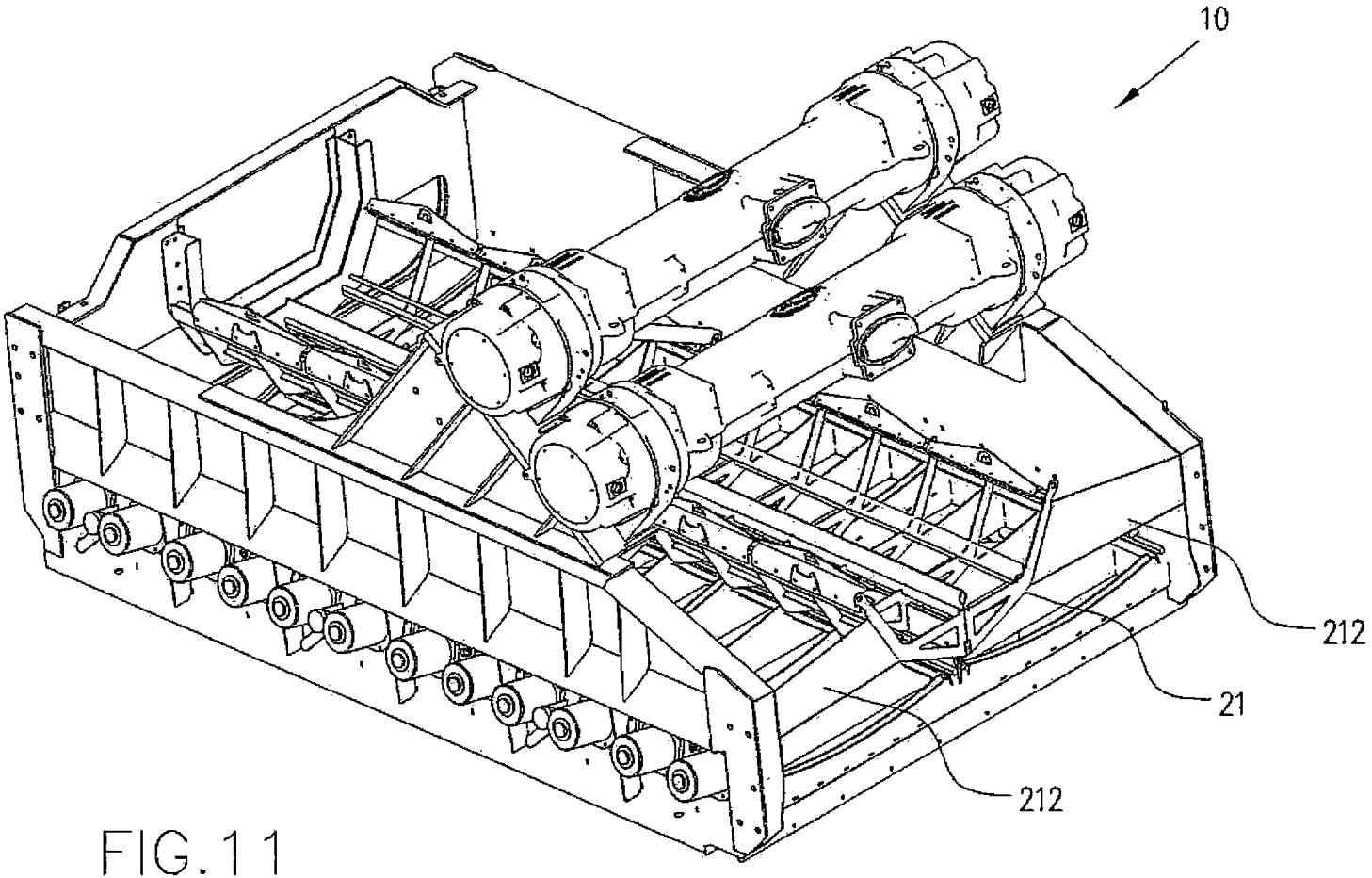
FIG. 11 shows a perspective view of the frame shown in FIG. 9 attached to a vibratory screening machine.

FIG. 11 shows frame 21 arranged on vibratory screening machine 10. Frame 21 may have additional support members 212 that provide for additional stability with respect to vibratory screening machine 10. The additional support members 212 may be provided in different configurations including configurations structured to provide maximum vibrations from vibratory screening machine 10.

Figure 12:
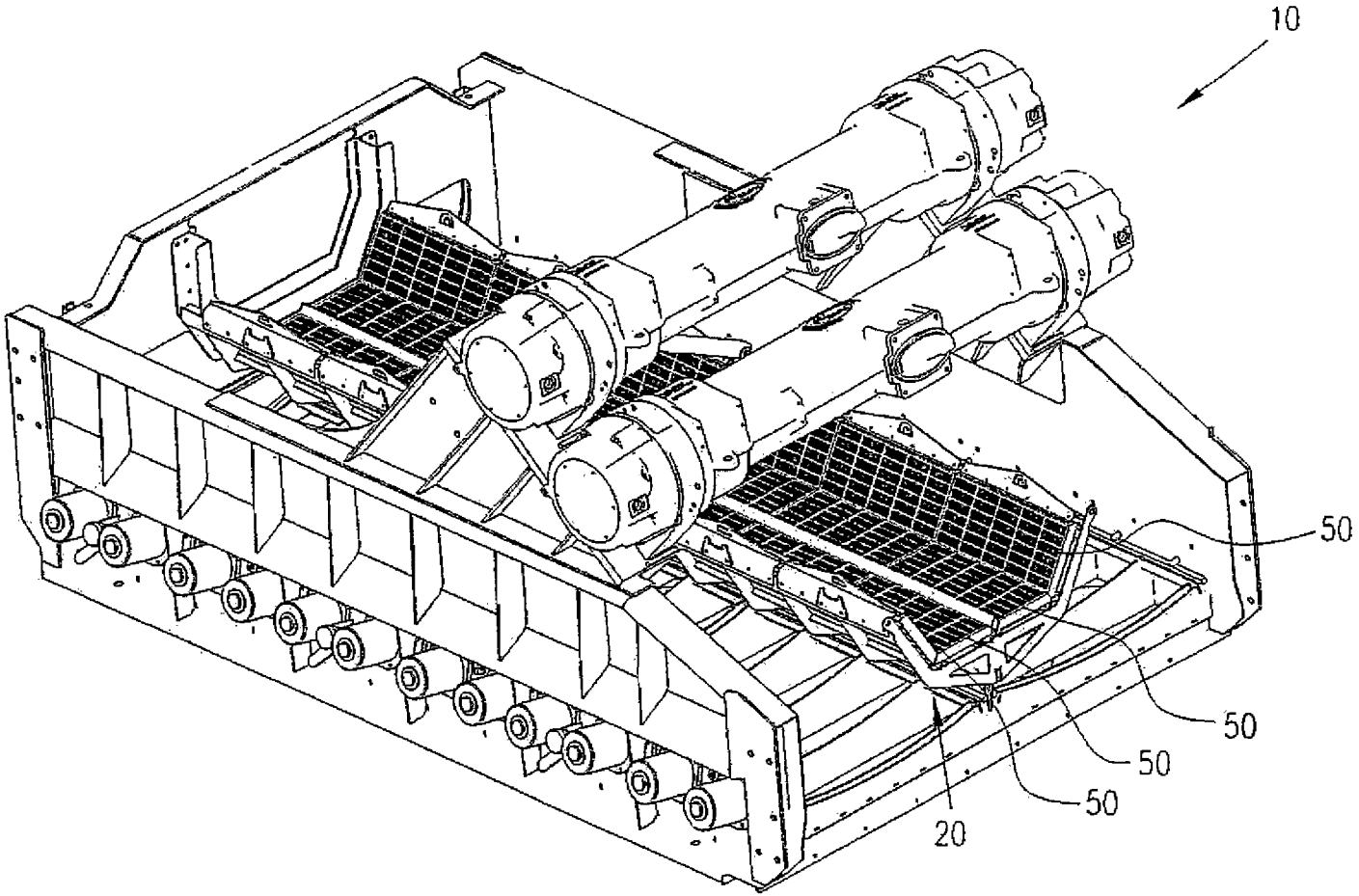
FIG. 12 shows a perspective view of pre-screening assembly shown in FIG. 10.

FIG. 12 shows pre-screening assembly 20 arranged on vibratory screening machine 10. Pre-screening assembly 20 includes screen assemblies 50.

Figure 13:
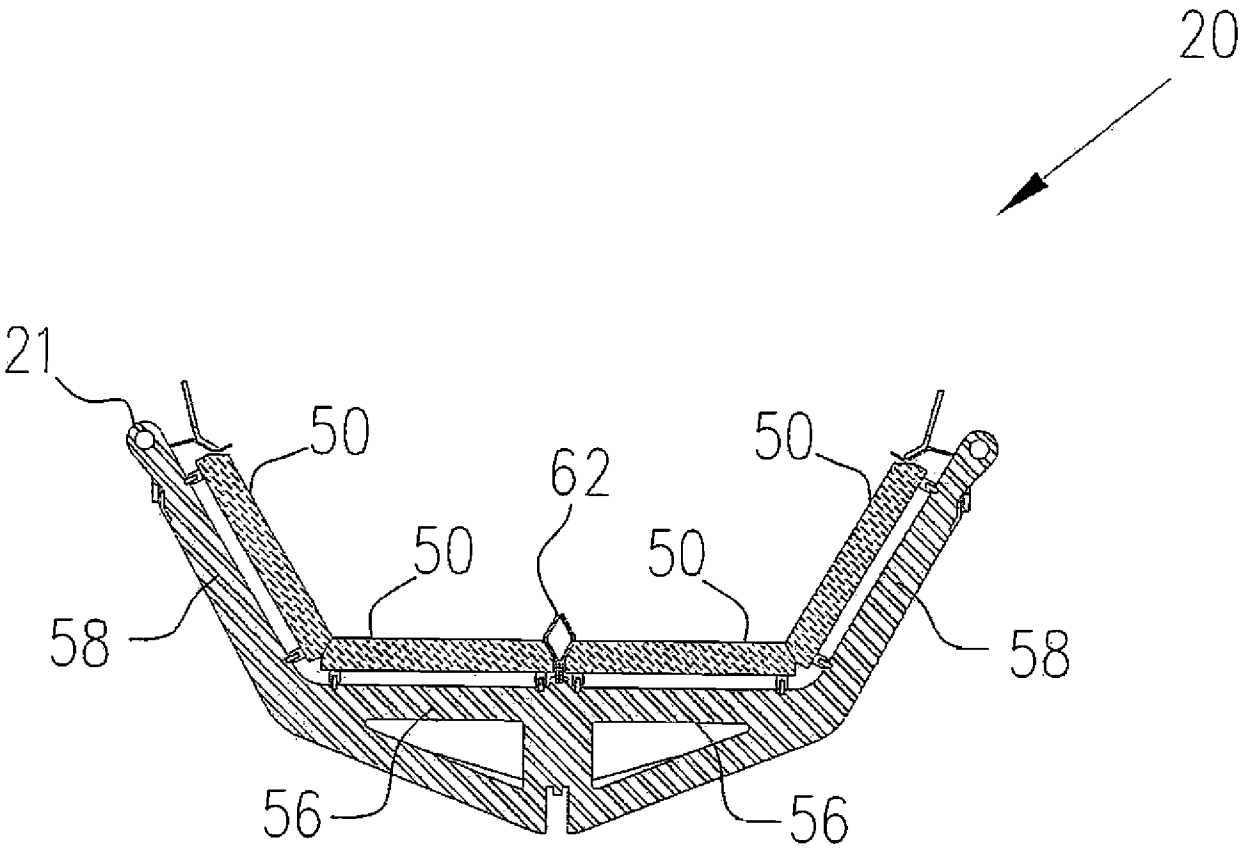
FIG. 13 shows a cross-sectional view of a pre-screening assembly according to an example embodiment of the present invention.

FIG. 13 shows pre-screening assembly 20 with frame 21, screen assemblies 50, bar 62, horizontal portions 56 and vertical portions 58. Screen assemblies 50 form a concave screening surface and bar 62 forms a keel like spine at the bottom of the concave screening surface.

Figure 14:
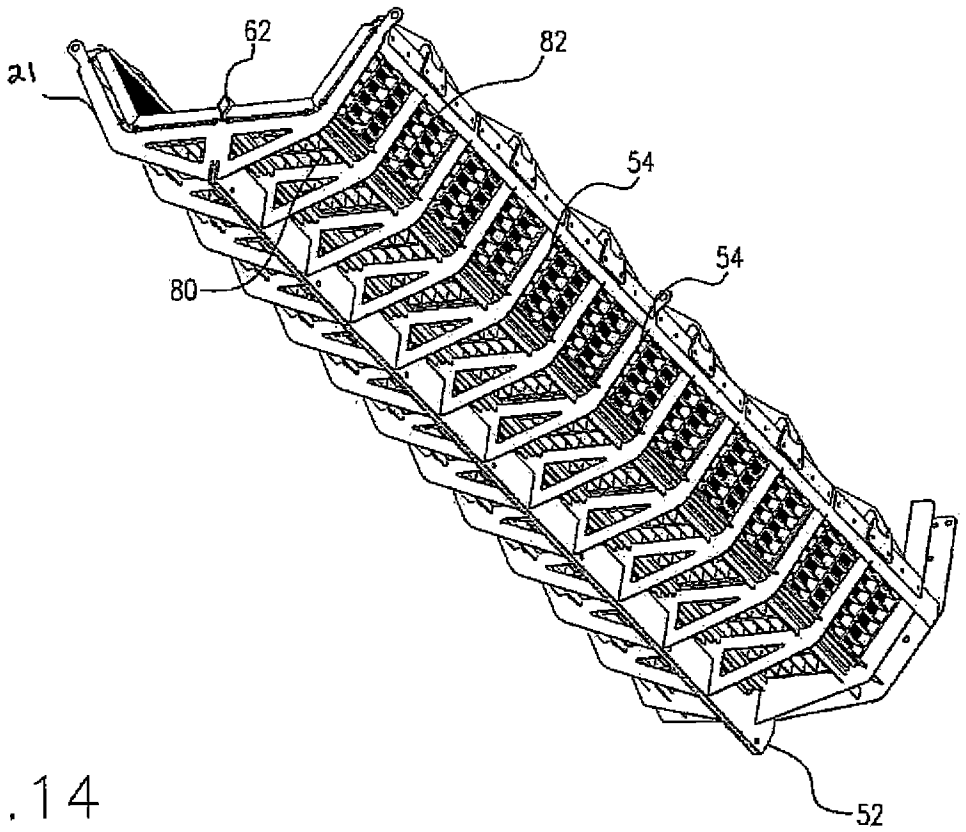
FIG. 14 shows a perspective view of a pre-screening assembly according to an example embodiment of the present invention.

FIG. 14 shows frame 21 with ribs 54 and central spine 52. Ribs 54 provide for horizontal and vertical inner surfaces 80 and 82, respectively. The ribs are spaced along the keel like spine 52.

Figure 15:
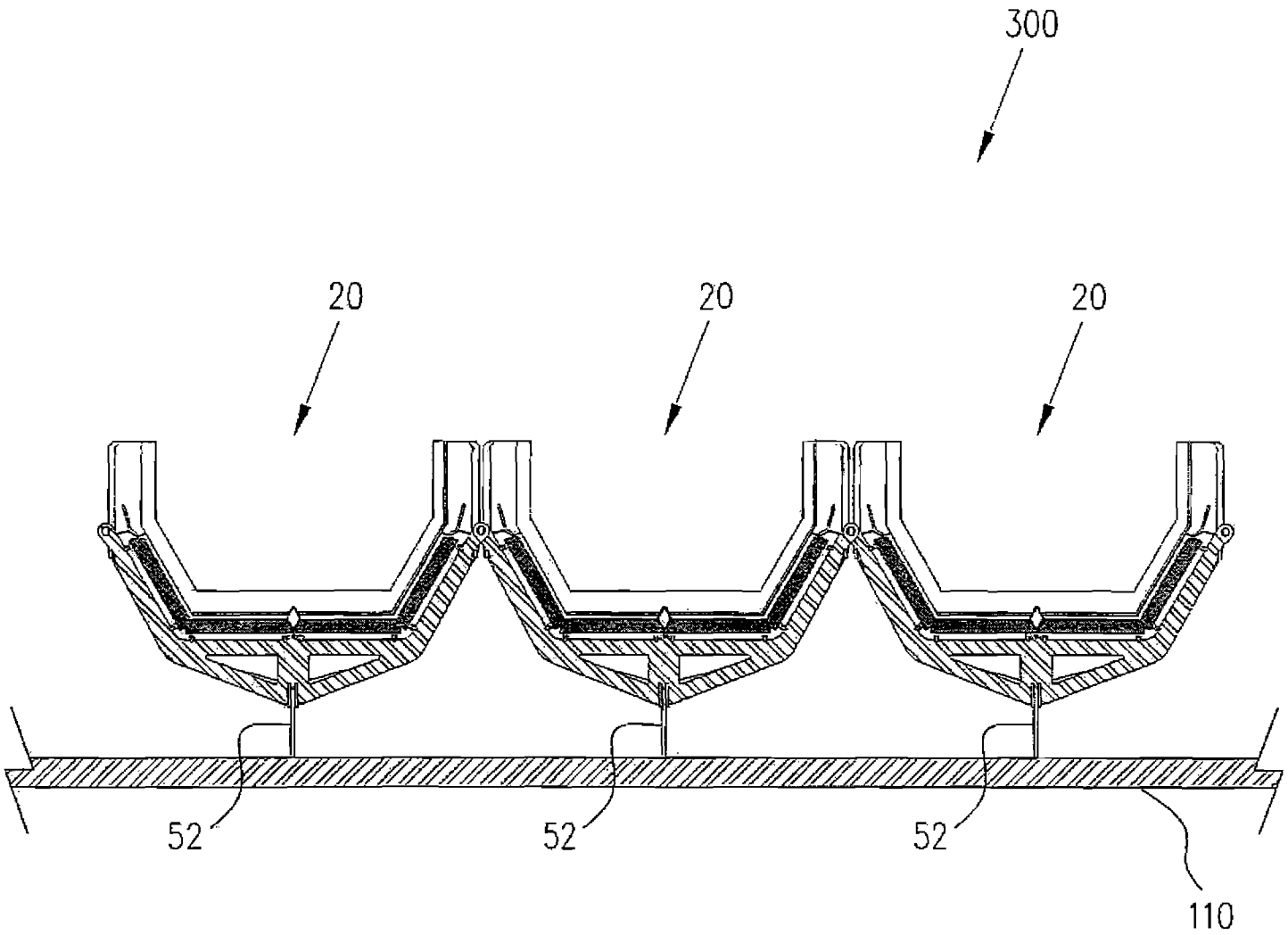
FIG. 15 shows a cross-sectional view of pre-screening assemblies according to an example embodiment of the present invention.

FIG. 15 shows a pre-screening arrangement 300 that includes three pre-screening assemblies 20 placed side by side. The pre-screening assemblies 20 are located above primary screening surface 110 and attached to vibratory screening machine 10 by member 52. Although three pre-screening assemblies 20 are shown multiple pre-screening assemblies may be provided. Additionally, pre-screening assemblies 20 may be secured to each other such that they form a connecting network. Each pre-screening assembly 20 has a concave screening surface. Alternative configurations may be structured such that different screening surfaces profiles are provided.

Figure 16:
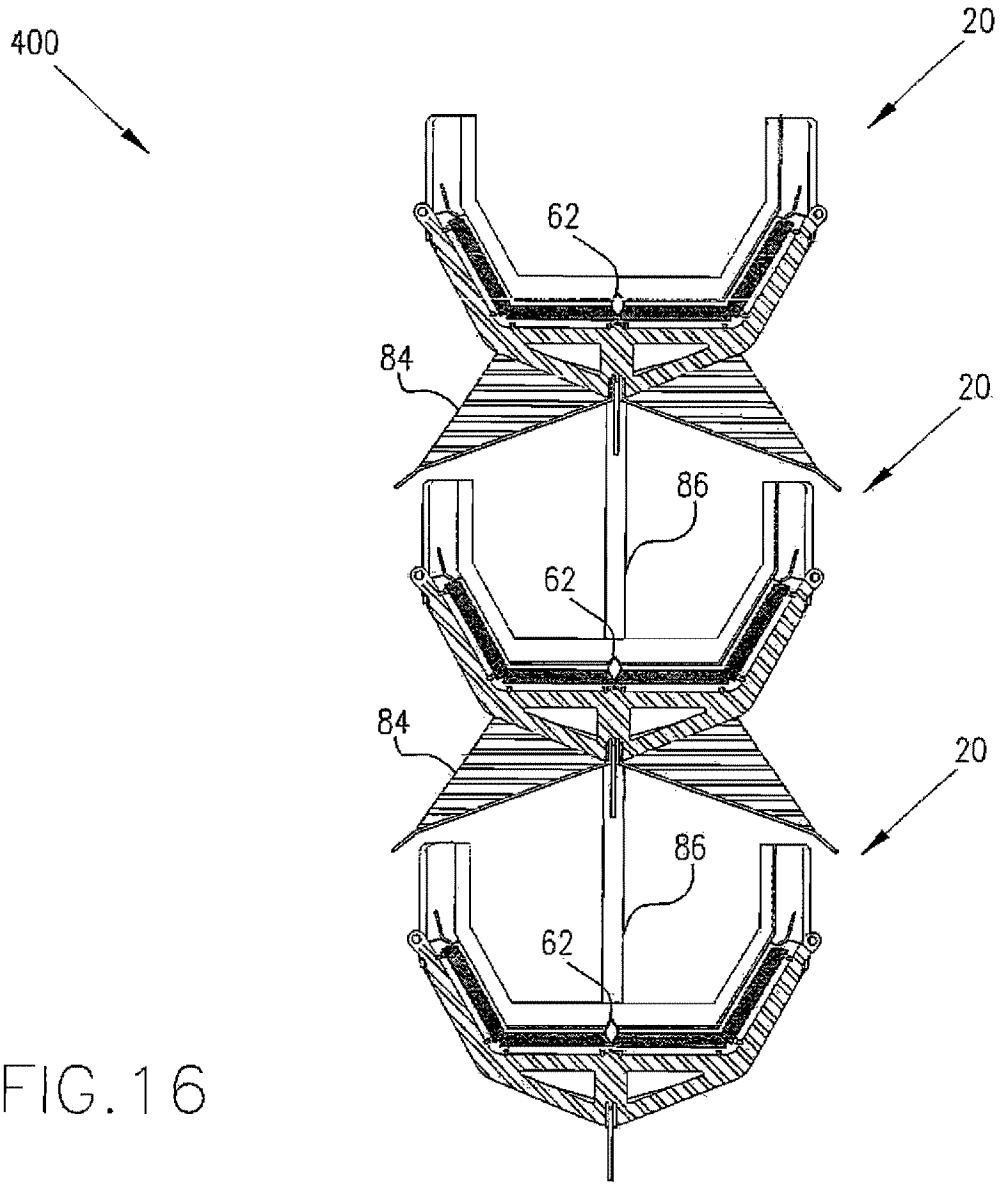
FIG. 16 shows a cross-sectional view of pre-screening assemblies according to an example embodiment of the present invention.

FIG. 16 shows pre-screening arrangement 400. Pre-screening arrangement 400 includes three pre-screening assemblies 20 arranged one above another. The top two pre-screening assemblies 20 include a bar 62 and an elongated member or spine 86. Elongated members 86 attach pre-screening assemblies 20 to the bar 62 of the pre-screening assembly 20 below it. The top two pre-screening assemblies 20 also include deflector arrangements 84 located on their lower surfaces. Deflector arrangements 84 direct material passing through the pre-screening assemblies 20 outward beyond the side plane of the framework beneath. Although three pre-screening assemblies 20 are shown, two or more pre-screening assemblies may be provided in such a vertical configuration. Additionally vertical arrangements may also be provided.

Figure 17:
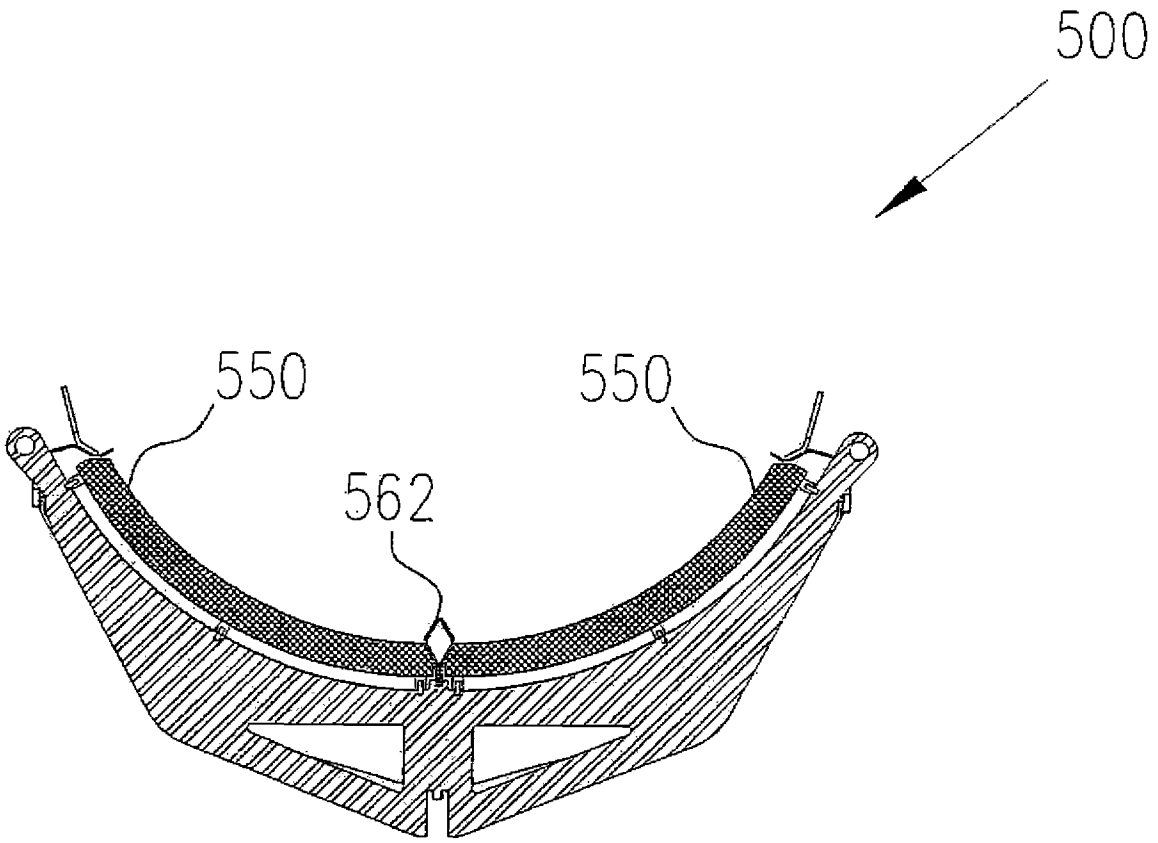
FIG. 17 shows a cross-sectional view of a pre-screening assembly according to an example embodiment of the present invention.

FIG. 17 shows a pre-screening assembly 500. Pre-screening assembly 500 includes two screen assemblies 550 positioned such that one side is in contact with locating bar 562 and another side if fastened by a screen assembly attachment arrangement (which may include attachment arrangements as described above) such that screen assemblies are formed into a concave shape including curved surfaces. Although two screen assemblies 550 are shown multiple screen assemblies 550 may be provided.

FIGS. 18 to 20 show the removal of a screen assembly 50 from a pre-screening assembly 20. Pre-screening assemblies 20 include pre-tension spring clamps 60 that secure screen assemblies 50 against bar 62. Pre-tension spring clamps 60 include a leaf spring 90 that applies a force to an edge of screen assemblies 50 pushing screen assemblies 50 against bar 62. Pre-tension spring clamps 60 are attached to frame 21 and include a notched fulcrum 92 and spring pull off 94. When member 96 is placed on notched fulcrum 92 and in spring pull off 94 and pushed downwardly in direction 97 leaf spring 90 is lifted off the edge of screen assembly 50 and screen assembly 50 may be removed. When the downward pressure is taken off member 96 leaf spring 90 returns to its original position. As described above, alternative screen assembly attachment arrangements may be provided.

Figure 21:
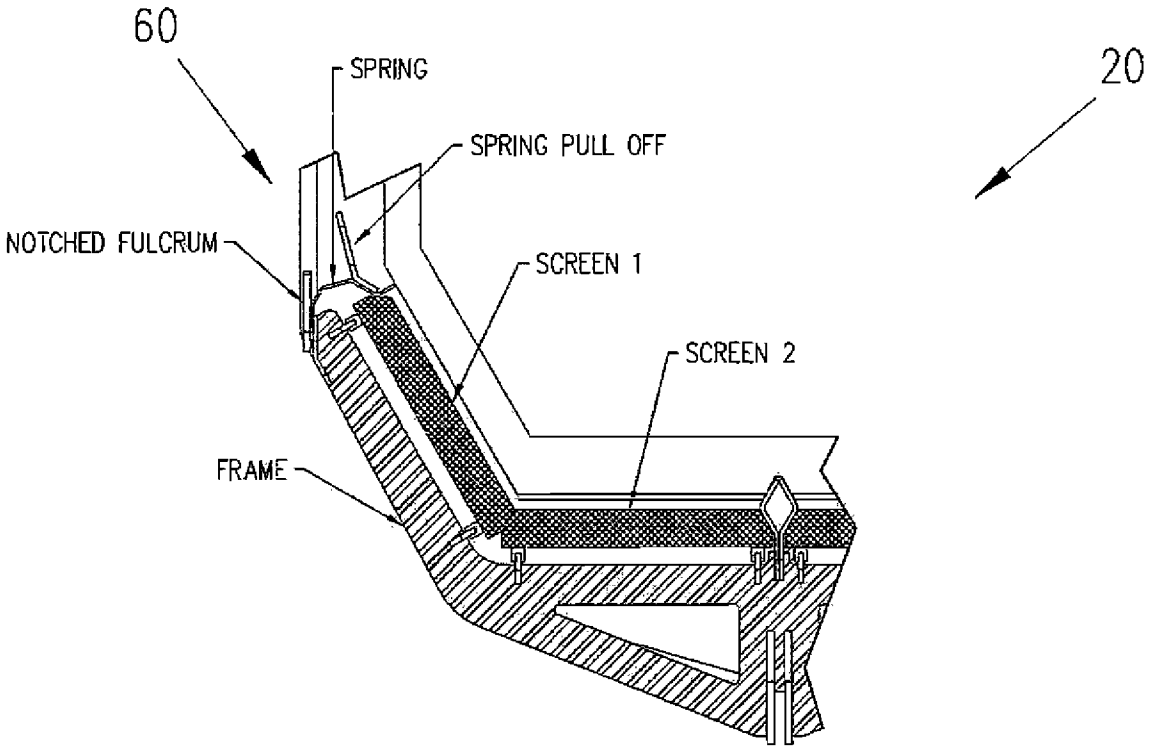
FIG. 21 shows a partial cross-sectional view of a pre-screening assembly according to an example embodiment of the present invention.

FIG. 21 shows pre-screening assembly 20 and pre-tension spring clamp assembly 60 with labeled parts.

Figure 22:
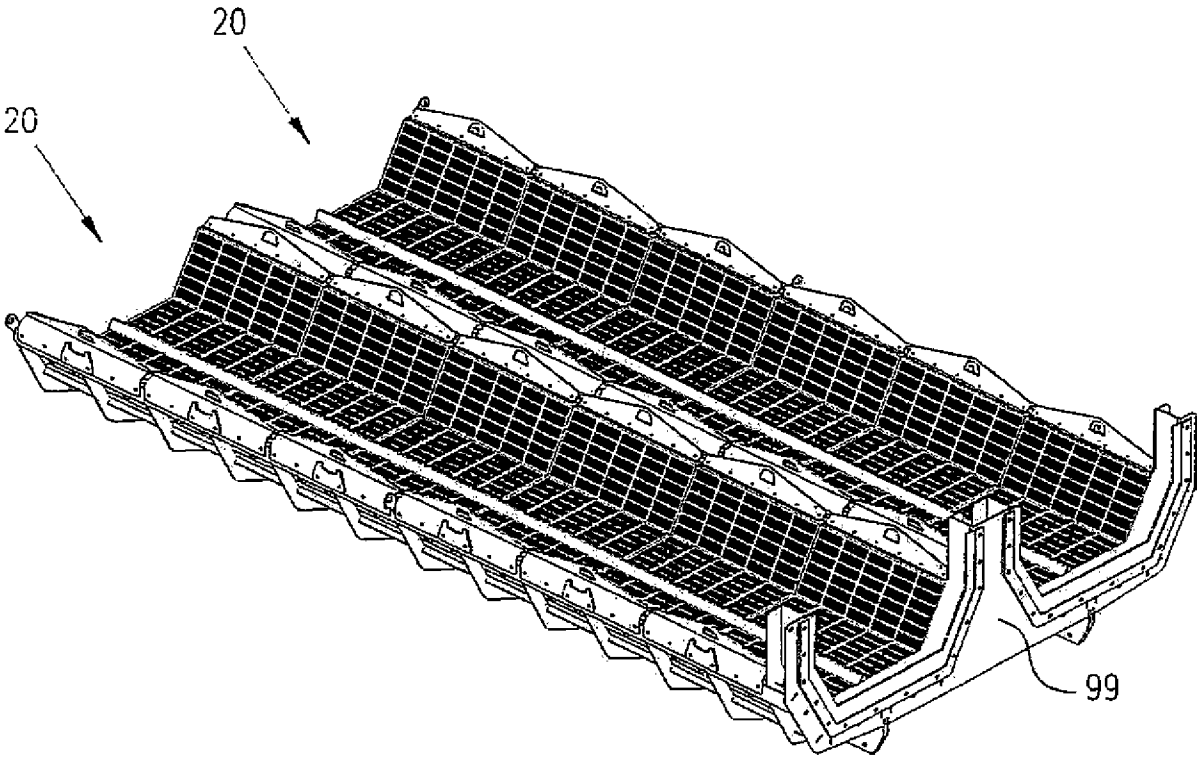
FIG. 22 shows a perspective view of pre-screening assemblies according to an example embodiment of the present invention.

FIG. 22 shows pre-screening assemblies 20 in a side by side arrangement with a common flange 99 for attachment to a feeder. Although two pre-screening assemblies 20 are shown multiple pre-screening assemblies 20 may be provided.

A method for screening materials includes attaching a pre-screen assembly to a vibratory screen machine, the pre-screen assembly including an elongated spine and concave screening surface, pre-screening material on the concave screening surface and screening material on a primary screening surface. The method may also include vibrating the pre-screen assembly, accelerating the screen assembly, returning the screen assembly to its original shape and replacing the screen assembly with another screen assembly.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than in a restrictive sense.

The invention claimed is:

1. A vibratory screening machine, comprising:

a primary screening surface disposed between first and second walls of the screening machine;

a central member dividing the primary screening surface into two screening areas; and a pre-screening assembly including a frame having a central spine and screen assemblies, the screen assemblies secured to the frame and forming a pre-screening trough having a concave surface between first and second edges of the pre-screening assembly, and wherein the central spine of the frame is configured to be attached to the central member of the vibratory screening machine such that the pre-screening trough is suspended above the primary screening surface and the first and second edges of the pre-screening assembly are spaced from the first and second walls of the screening machine, respectively.

2. The vibratory screening machine of claim 1, further comprising a vibratory motor, the vibratory motor configured to vibrate at least one of the pre-screening assembly and the primary screening surface.

3. The vibratory screening machine of claim 1, further comprising at least one additional pre-screening assembly.

4. The vibratory screening machine of claim 1, wherein the frame includes at least one rigid portion.

5. The vibratory screening machine of claim 1, further comprising a feeder configured to divert a material flow to at least one of the pre-screening assembly and the primary screening surface.

6. The vibratory screening machine of claim 1, wherein the screen assemblies further comprise:

a first substantially vertical screen assembly;

a first substantially horizontal screen assembly;

a second substantially vertical screen assembly; and a second substantially horizontal screen assembly, wherein the first substantially vertical screen assembly is at an angle relative to the first substantially horizontal screen assembly and the second substantially vertical screen assembly is at an angle relative to the second substantially horizontal screen assembly.

7. The vibratory screening machine of claim 1, wherein the primary screening surface includes a concave screening surface.

8. The vibratory screening machine of claim 1, further comprising a screen assembly attachment arrangement configured to secure the screen assemblies to the frame.

9. The vibratory screening machine of claim 8, wherein the screen assembly attachment arrangement includes a pre-tension spring clamp that is configured to secure the screen assemblies to the frame.

10. The vibratory screening machine of claim 1, wherein the frame includes ribs.

11. The vibratory screening machine of claim 10, wherein the frame is elongated and the central spine and the ribs extend substantially along a length of the frame.

12. The vibratory screening machine of claim 10, wherein the screen assemblies include horizontal portion screen assemblies and vertical portion screen assemblies and the ribs include horizontal and vertical rib portions, the horizontal rib portions extending substantially perpendicular to the spine, the vertical rib portions extending substantially perpendicular to the horizontal rib portions, wherein the horizontal portion screen assemblies and vertical portion screen assemblies are arranged on the horizontal and vertical rib portions, respectively.

13. The vibratory screening machine of claim 12, further comprising a screen assembly attachment arrangement configured to press the horizontal portion screen assemblies and vertical portion screen assemblies together to form the pre-screening trough.

14. The vibratory screening machine of claim 13, wherein the frame includes a central key stop and the screen assembly attachment arrangement presses the vertical portion screen assemblies against the horizontal portion screen assemblies, the horizontal portion screen assemblies pressing against the central key stop.

15. The vibratory screening machine of claim 1, wherein the central member divides the primary screening surface into a first concave screening surface and a second concave screening surface.

16. The vibratory screening machine of claim 1, wherein the central member divides the primary screening surface into two screening areas and vibrations are imparted from the vibratory screening machine to the frame primarily through the central member.

17. The vibratory screening machine of claim 16, wherein the vibrations are transferred from the vibratory screening machine to the frame exclusively from the central member to the central spine.

18. A pre-screening assembly for a vibratory screening machine, comprising:

a frame having a central spine;

screen assemblies, including a first substantially vertical screen assembly, a second substantially vertical screen assembly and at least one substantially horizontal screen assembly, wherein the first and second substantially vertical screen assemblies are each disposed at an angle relative to the substantially horizontal screen assembly; and wherein the frame is configured to be attached to a central member of the vibratory screening machine and the screen assemblies are secured to the frame forming a pre-screening surface having a concave surface.

19. The pre-screening assembly of claim 18, further comprising a screen assembly attachment arrangement configured to secure the screen assemblies to the frame.

20. The pre-screening assembly of claim 18, wherein the frame includes at least one rigid portion.

21. The pre-screening assembly of claim 18, wherein the frame includes ribs.

22. The pre-screening assembly of claim 21, wherein the frame is elongated and the central spine and the ribs extend substantially along a length of the frame.

23. The pre-screening assembly of claim 21, wherein the screen assemblies include horizontal portion screen assemblies and vertical portion screen assemblies and the ribs include horizontal and vertical rib portions, the horizontal rib portions extending substantially perpendicular to the spine, the vertical rib portions extending substantially perpendicular to the horizontal rib portions, wherein the horizontal portion screen assemblies and vertical portion screen assemblies are arranged on the horizontal and vertical rib portions, respectively.

24. The pre-screening assembly of claim 23, further comprising a screen assembly attachment arrangement configured to press the horizontal portion screen assemblies and vertical portion screen assemblies together to form the pre-screening surface.

25. The pre-screening assembly of claim 24, wherein the frame includes a central key stop and the screen assembly attachment arrangement presses the vertical portion screen assemblies against the horizontal portion screen assemblies and presses the horizontal portion screen assemblies against the central key stop.

26. The pre-screening assembly of claim 18, wherein the vibratory screening machine further comprises:

a primary screening surface; and a vibratory motor, wherein the vibratory motor is configured to vibrate at least one of the pre-screening surface and the primary screening surface.

27. The pre-screening assembly of claim 26, wherein the primary screening surface includes first and second primary screening surfaces, and wherein the central member is located between the first and second primary screening surfaces.

28. The pre-screening assembly of claim 26, wherein the primary screening surface includes a concave screening surface.

29. The pre-screening assembly of claim 26, wherein the central member divides the primary screening surface into a first concave screening surface and a second concave screening surface.

30. The pre-screening assembly of claim 26, wherein the central member divides the primary screening surface into two screening areas and vibrations are imparted from the vibratory screening machine to the frame primarily through the central member.

31. The pre-screening assembly of claim 30, wherein the vibrations are transferred from the vibratory screening machine to the frame exclusively from the central member to the central spine.

32. The vibratory screening machine of claim 18, wherein the screen assemblies include a first screen assembly configured to form a predetermined shape when pressed against a portion of the frame and a second screen assembly, located opposite the first screen assembly, configured to form a predetermined shape when pressed against an opposite side of the portion of the frame, the first and second screen assemblies forming a section of a concave pre-screening surface.

33. A method of screening a material, the method comprising:

attaching a pre-screening assembly to a central member vibratory screen machine, the vibratory screen machine including a primary screening surface disposed between first and second walls of the screening machine, the primary screening area being divided into two screening areas by the central member and the pre-screen assembly including a pre-screening trough having a concave surface between first and second edges, wherein the pre-screening trough is suspended above the primary screening area and the first and second edges of the pre-screening assembly are spaced from the first and second walls of the screening machine, respectively;

pre-screening the material on the pre-screening surface to generate a pre-screened material; and screening the pre-screened material on the primary screening surface.

34. The method of claim 33, further comprising vibrating at least one of the pre-screening assembly and the vibratory screening machine.

35. The method of claim 33, wherein the pre-screening assembly includes a frame and screen assemblies that form the pre-screening surface, the method further comprising:

securing the screen assemblies to the frame;

unsecuring and removing the screen assemblies; and replacing the screen assemblies.

* * * * *